United States Patent [19]

Reinstein et al.

[11] 4,393,667

[45] Jul. 19, 1983

[54] JEWELRY ARTICLES

[76] Inventors: Martine Reinstein, Valkenlaan 14a, B-1800 Vilvoorde, Belgium; Jacques Wurcel, Elfbunderslaan 18, B-1650 Beersel, Belgium

[21] Appl. No.: 271,875

[22] Filed: Jun. 9, 1981

[30] Foreign Application Priority Data

Aug. 20, 1980 [BE] Belgium ..... 201799

[51] Int. Cl.[3] ..... A44C 17/02

[52] U.S. Cl. ..... 63/29 R

[58] Field of Search ..... 63/29 R, 20, 15

[56] References Cited

U.S. PATENT DOCUMENTS

| | | | |
|---|---|---|---|
| 684,272 | 10/1901 | Lambert | 63/29 R |
| 774,781 | 11/1904 | Robbins | 63/29 R |
| 984,682 | 2/1911 | Lott | 63/29 R |
| 2,316,225 | 4/1943 | DeHoffman et al. | 63/29 R |
| 2,914,928 | 12/1959 | Warden | 63/29 R X |
| 3,133,331 | 5/1964 | Marticorena | 63/29 R X |
| 3,192,737 | 7/1965 | Schechter | 63/29 R X |

FOREIGN PATENT DOCUMENTS

| | | | |
|---|---|---|---|
| 620113 | 10/1935 | Fed. Rep. of Germany | 63/13 |
| 16961 | of 1892 | United Kingdom | 63/29 R |

*Primary Examiner*—F. Barry Shay

*Attorney, Agent, or Firm*—Sughrue, Mion, Zinn, Macpeak, and Seas

[57] ABSTRACT

A set of jewelry articles comprises a plurality of supports of different natures and/or sizes, such as rings, necklaces, bracelets, ear-rings and the like and one or more identical settings, such as baskets or bezels carrying precious stones. The settings are adapted so as to be fixable, in a removable manner, on any support of the plurality of supports by means of male and female coupling elements. The female coupling element is located inside the settings. Each support and/or each setting is provided with a blocking lever inhibiting a relative movement between the setting and the support on which the setting is fixed.

10 Claims, 23 Drawing Figures

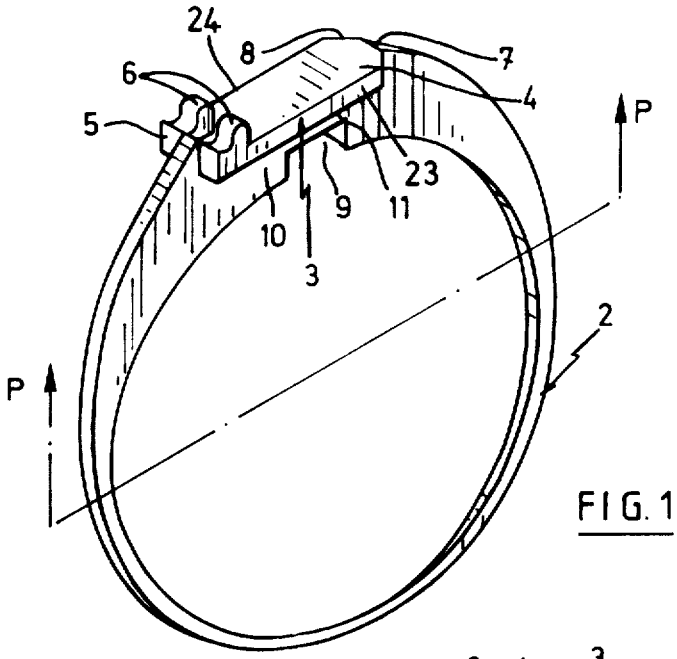
FIG. 1
FIG. 2
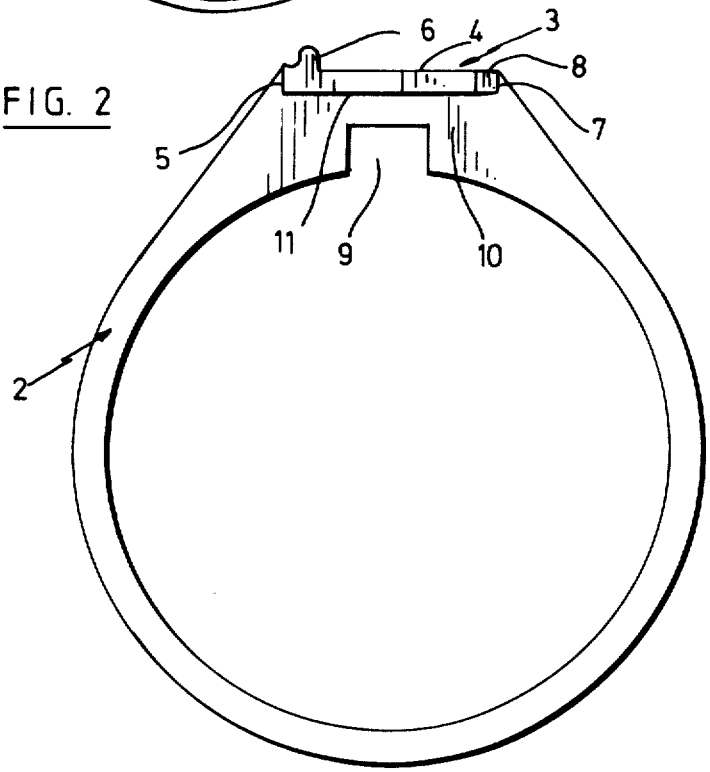

FIG 7
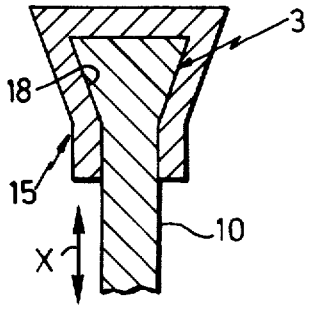
FIG 8
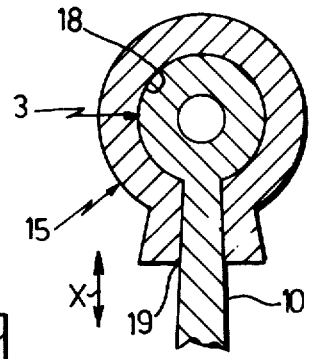
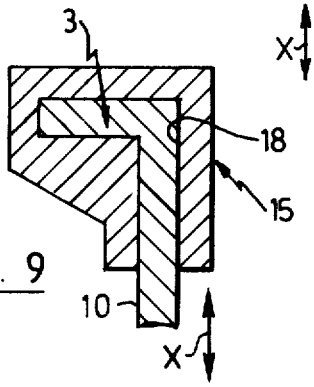
FIG. 9
FIG. 10
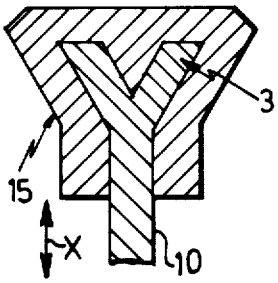
FIG. 11
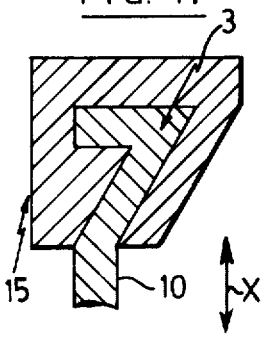
FIG 12
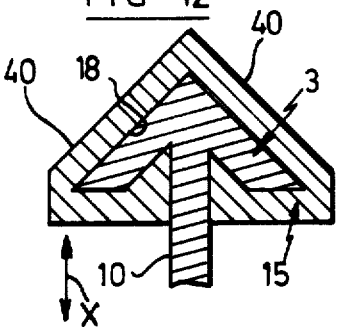
FIG. 13
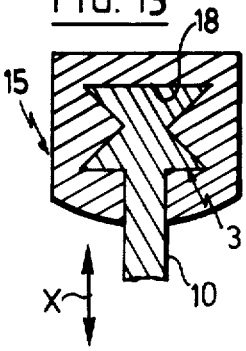
FIG. 14
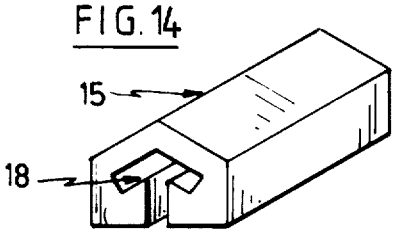

FIG. 19
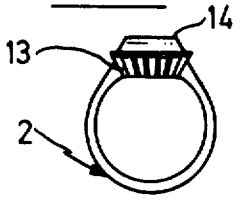
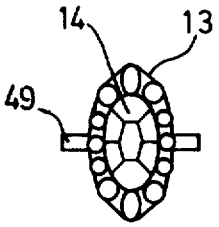
FIG. 22
FIG. 20
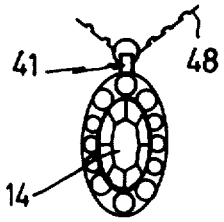
FIG. 21
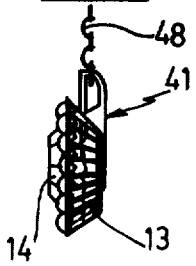
FIG. 23
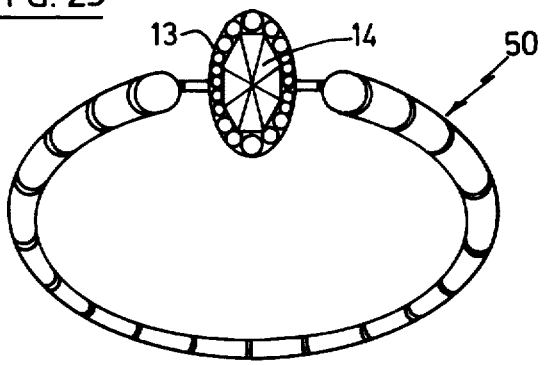

JEWELRY ARTICLES

BACKGROUND OF THE INVENTION

1. Field of the Invention

This invention relates to improvements to jewelry articles to be worn by a person. More particularly, the invention relates to jewelry article sets comprising a plurality of supports of different natures and/or sizes and one or more settings provided with identical receptacles.

2. Description of the Prior Art

As used throughout this application, the term "support" means a ring to be carried by a hand finger, a bracelet, an earring, a brooch, a necklace, a cuff-link, a sling of a pendant, a tie pin, a hair pin and generally any object or article to be used for ornamental purposes;

the term "setting" means a piece to be associated or linked to a support so as to form a jewel. The setting may be provided with at least one ornamental or adorning element which may possibly have a decorative design, such as initials, a blazon and the like, and may carry at least one stone which may be a precious stone and may possibly be cut, the stone being a natural mineral stone or a synthetic material, such as a diamond, sapphire, emerald, ruby, turquoise, opal, jade, onyx, coral, natural or synthetic pearls and the like. More generally, the setting comprises a basket for retaining stones in a proper position by crimping the claws of the basket;

the term "receptacle", as used in the present specification, means a piece which is permanently fixed to the setting, so as to contribute to the removability of the setting.

Rings comprising a basket carrying precious stones or non precious stones are known in the art.

For the manufacture of such a ring, two main parts are used, the first part being a ring and the second a basket in which the stones are set or crimped. These two parts are welded to each other and the set thus formed is submitted to a finishing work. For strength and aesthetic purposes, the height of the ring is frequently higher at the welding points, although some ring models are cast in one piece.

Thereafter, the precious or non precious stones are set or crimped into the basket, frequently by means of claws. In order to be reliable, this work requires very precise actions on the basket metal and also requires a finishing comprising a very fine polishing and a protecting rhodium treatment.

When the ring is offered for sale, it must be adapted to the size of the purchaser's finger. This size, calculated in millimeters of finger circumference, may vary widely and is generally between 45 and 65 millimeters. For adapting the ring to the finger size, the ring must be severed and deformed. Therefore metal must be added or removed in accordance with the need, the ring being then remodeled, again welded, polished and again treated with rhodium.

These various operation steps have many drawbacks.

First, the stresses imposed to the metal may break the ring, when the latter comprises, as frequently occurs, some imperfections. These stresses may also cause a deformation of the basket and these deformations, though they are not always visible, involve a risk of loss of the stones during the use of the jewel.

Second, in many cases, a previous decrimping of the stones is necessary since some stones do not withstand heat. Such a decrimping may cause breakages which are difficult to repair.

Third, all these manipulations may require more or less long periods of time, in accordance with the technical skills of the saler since the seller seldom has a repair workshop at the place where the sale takes place. In most cases he has to rely on a supplier for the work to be done.

Sets of jewelry articles comprising a plurality of supports and at least one setting provided with a receptacle are known. In these known sets, the supports and settings may be interchangeably coupled to each other.

Generally, the known coupling systems of said sets have several drawbacks in so far as they have a complex structure and are not reliable. Particularly, they are at least partially visible, i.e. apparent, this being detrimental for the aesthetic character which is a mandatory feature of the ring.

U.S. Pat. Nos. 3,133,331 and 3,192,737 disclose sets of jewelry articles comprising a plurality of supports of different natures and/or sizes, at least one setting provided with an ornamental or decorative element on a front face and adapted for being coupled by its back face to any support of the plurality of supports, male and female means for coupling the setting or each setting to a support, as well as means for blocking the male and female elements in this coupled state.

U.S. Pat. No. 3,133,331 describes a device for fixing a setting receptacle to a support, such as a ring or a small chain. This device comprises two parts, the first being a fastener or clasp integral with the back face of a setting and the second being a block integral with the support. The clasp has the shape of a U, the base of which is welded to the back face of the setting. One side wall of the clasp carries a pivot on which is mounted a pivoting arm provided with tongues. In the other side wall the clasp is perforated and is provided with a catch element, so as to retain the tongues of an arm, when the latter has been pivoted toward the second or other lateral wall of the clasp.

The block which is fixed to the support has an opening extending from one face to the opposite face of the block, so that the latter can be drawn onto the pivoting arm of the clasp.

For fixing a support, such as a ring, to the receptacle of the setting, the block carried by the support is drawn on the raised arm of the clasp, the latter being then pivoted counter-clockwise by 90° toward the second arm of the clasp, until the tongues of the arm are catched by the catch element of the second clasp side wall.

The fixation device disclosed in U.S. Pat. No. 3,133,331 may accidentally be released, since the arm on which the block is drawn needs only to pivot counter-clockwise about 45° in order to separate the setting from the support. Such a pivotal movement may very well occur by accident.

Moreover, the clasp and the block which form the fixing device are visible, since they are located outside the setting which detracts from the aesthetic appeal of the jewel. This disadvantage is particularly major in the case of a jewel.

Furthermore, when the setting is used together with a small chain so as to form a pendant, the device for suspending the setting to the chain, which is located at the center of the back plane of the setting, results in the pendant being unbalanced in its use position.

U.S. Pat. No. 3,192,737 describes a ring provided with a removable setting which can be converted into a pendant. The setting carries a pivot of a lever, the free end of which may be suspended to the setting in its closed position, in which the lever extends perpendicularly to the median plane of the ring, the lever extending in a groove which is open toward the center of the ring. This groove is made by an inversed U-shaped part of the ring, the width of the groove being just sufficient for enabling the lever to extend in it, when in the closed position. The ring is also provided, on both sides of the grooved inversed U-shaped part, with a projection which becomes embedded in a hole of the setting.

In the system described in the U.S. Pat. No. 3,192,737, when the lever is in its closed position, the ring cannot rotate around its center with regard to the setting. However, this system may also accidentally be released when a pulling force is exerted onto the ring or the setting, the end of the lever, opposed to the end mounted on its pivot, may easily become detached from the setting, so that the lever is opened by pivoting around its pivot. As soon as the lever is opened due to such a pulling force, the ring and its setting are no longer locked together, so that the setting may be lost.

Moreover, the system described in the U.S. Pat. No. 3,192,737 is only suitable for a single ring having determined dimensions. Indeed, in view of the means for coupling the ring to the setting, it is not possible, when this system is used, to replace a ring which fits correctly in the setting by another ring having a greater or smaller outer diameter, without the need of using a special setting having different dimensions. The system according to the U.S. Pat. No. 3,192,737 does therefore not allow the use of rings of different sizes together with a single setting or the use of different settings with a plurality of rings having different sizes.

Furthermore, the system according to U.S. Pat. No. 3,192,737 allows the use of the setting as a pendant, suspended to the lever acting as a sling. However, the sling is located on the back face of the support substantially outside the vertical plane containing the center of gravity of the jewel, so that the latter is strongly unbalanced when it is suspended from a chain.

Finally, the system disclosed in U.S. Pat. No. 3,192,737 is provided with a receptacle of such a nature and position that it is clearly visible and considerably reduces the possible variations of the sizes and of the aesthetic character of the jewel.

SUMMARY OF THE INVENTION

It is therefore an object of this invention to provide jewelry article sets having supports and settings which may be coupled together or separated from each other, without having the disadvantages of the known sets.

It is a further object of this invention to provide jewelry article sets in which the coupling means are simple, quite reliable and invisible.

It is yet a further object of the invention to provide jewelry article sets in which the means for coupling a determined setting to any support of the plurality of supports are such that they are entirely concealed within the setting, so that the jewel has the appearance of a normal jewel in which the setting is permanently attached to the support. In addition no accidental uncoupling is possible between the setting and the support in the sets according to this invention.

This invention relates therefore to a jewelry article set comprising a plurality of supports of different natures and/or sizes and at least a setting which is provided with an ornamental element on a front face and which may be coupled by its back face to any support of said plurality of supports, male and female means for coupling the setting or each setting to a support, as well as a blocking lever of the male and female elements in their coupling state. According to the invention, the female element of the coupling means is located and permanently fixed inside the setting or each setting and is provided with a slide or groove which is open toward the back face of the setting and toward two opposite faces of said female element. The cross section of the slide has at least one part which is broader than the opening of the slide directed toward the back face of the setting. On the other hand, the male element of the coupling means forms a part of the support and comprises a part having a shape which is complementary to that of the slide, so that, when the latter part of the male element has been inserted into the slide of the female element, it is impossible to disengage the male element from the female element through the opening of the female element directed toward the back face of the setting. The blocking lever is adapted so that, when in the use position, it extends within the setting or each setting and inhibits any sliding of the male element into the female element, when said male element has been engaged or inserted into the female element.

According to a feature of the invention, the blocking lever is carried, at one end, by a pivot attached to the female element of the coupling means and is provided, at its opposite end, with means for gripping it to a boss of the female element mounted entirely within the setting or each setting.

In its use position, i.e. in the blocking position, the lever preferably extends substantially in the plane of the back face of the setting or each setting and is preferably embedded in a groove provided in the face of the female element of the coupling means, which is coplanar with the back face of the female element, the groove preferably extending perpendicularly to the opening of the slide of the female element directed toward the back face of the setting.

Preferably, the female element is a receptacle having such dimensions that it can be located and permanently fixed inside each setting, so that its face in which the slide opens is substantially coplanar with the back face of the setting or each setting.

According to an important feature of the invention, each support of the plurality of supports has a notch through which the blocking lever extends when the latter is in the use position, the notch being provided in the part of the support engaged or inserted in the slide of the female element or nested within the setting or each setting.

The male element which is substantially the same for each support of the plurality of supports comprises, in accordance with this invention, a part having a shape which corresponds to that of the part of the slide which is broader than the opening of the slide, as well as a part which is narrower and has the shape of the part of the slide in which is provided the opening which opens into the back face of the setting or each setting.

The broader part of each support is a projection, preferably a platelet in one piece with each support.

BRIEF DESCRIPTION OF THE DRAWINGS

FIG. 1 is a perspective view of a support comprising a ring provided with a male coupling element on which a female coupling element of a setting has to be engaged;

FIG. 2 is a side view of the support and of its male coupling element shown in FIG. 1;

FIGS. 7 to 13 are cross-sections showing various shapes of parts of the male coupling elements of a support and various shapes of slides of the female coupling elements located in settings having different possible forms;

FIG. 14 is a perspective view of an embodiment of a female coupling element, the slide of which may receive the male element shown in FIG. 12;

FIGS. 19 to 23 are small scale views of jewels manufactured according to this invention.

In these figures, some of which are on a large scale, the same reference numbers refer to identical elements.

DESCRIPTION OF THE PREFERRED EMBODIMENTS

Figure 3:
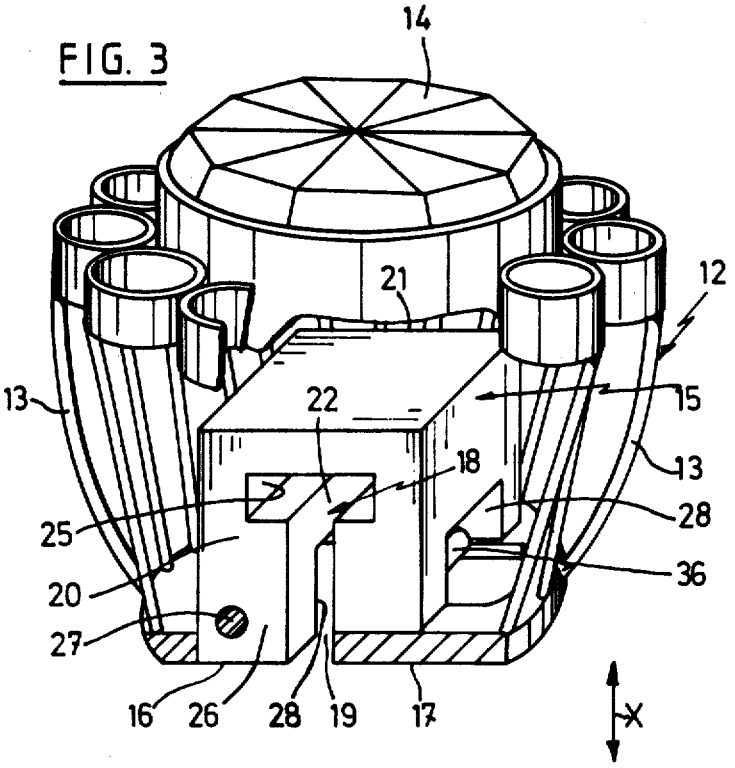
FIG. 3 is a perspective view of a setting adaptable on the support shown in FIG. 1, the view being partially broken so as to show the female element of the coupling means, which is mounted inside the setting.

FIGS. 1 and 2 show a support designated generally by reference numeral 2 and comprising a ring and a male coupling element comprising a projection 3 having the shape of a platelet or head which is integral with the ring. The upper surface 4 of the platelet 3 carries, at one end 5, two stops 6, which are used for stopping a female coupling element located inside a setting, when the male element is inserted into the female element. Instead of being carried by the upper face 4 of platelet 3, the stop 6 may be carried by the lower face 11 of the platelet 3. The end 7, opposite to end 5, of the platelet 3, which is a part of the male coupling element, narrows or is bevelled as shown by reference 8, so as to facilitate the insertion of the platelet in a female coupling element located inside a setting.

In the part 10 of the ring 2 extending below the platelet 3, there is a notch 9, the function of which will be explained later.

Figure 5:
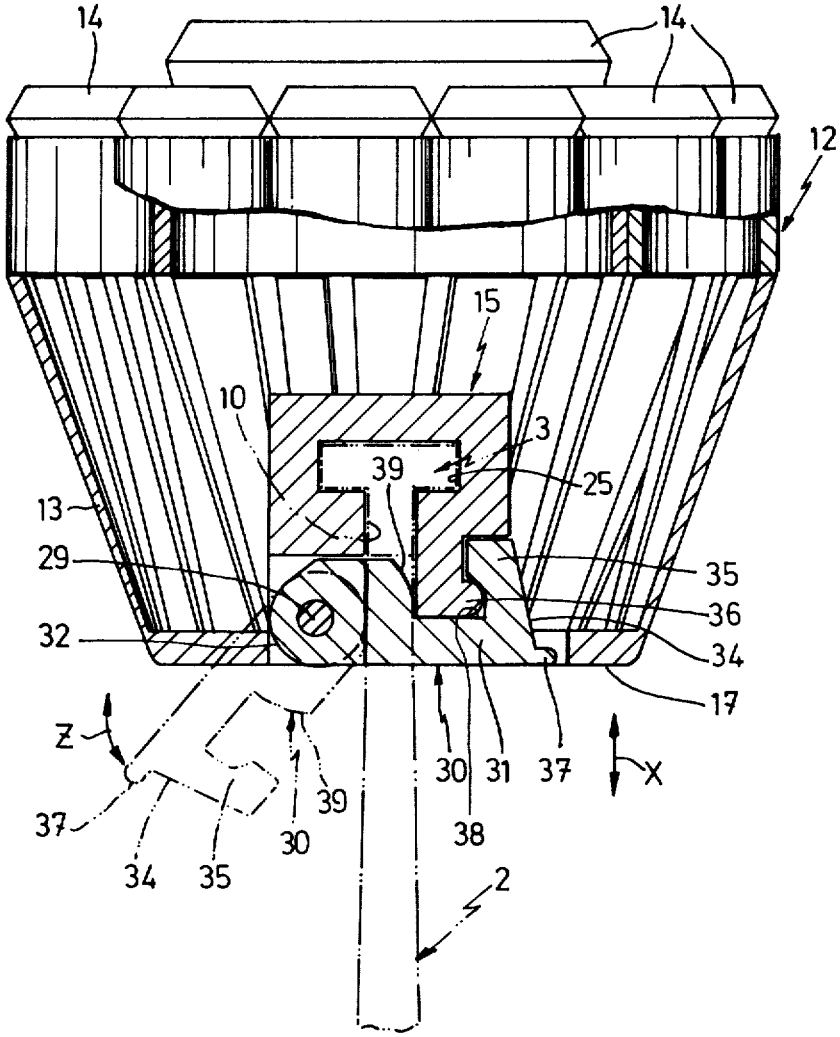
FIG. 5 is a cross-section of a setting in which a female coupling element equipped with a blocking lever is located, the figure showing also in dot and dash lines an adjacent part provided with a male coupling element of the support.
Figure 6:
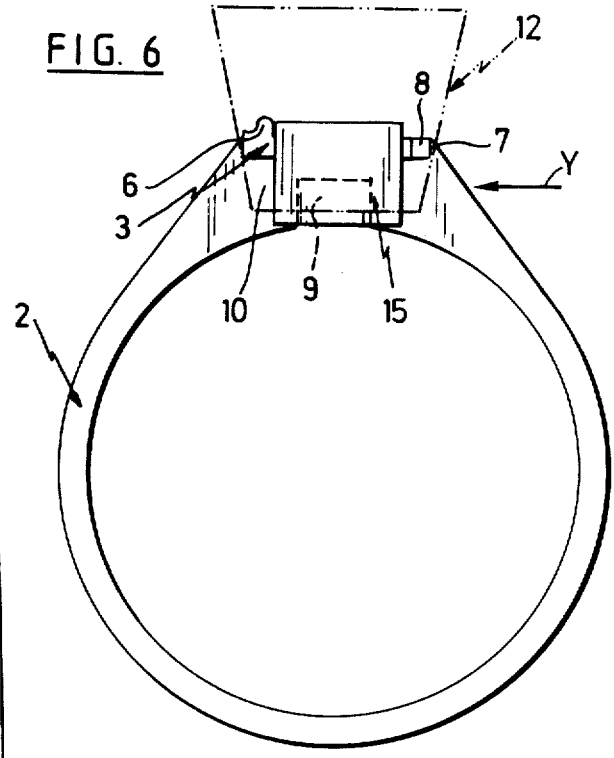
FIG. 6 is a side view of a jewel article comprising a ring (support) comprising a projection forming a part of its male coupling element, on which is locked or clamped the female element mounted within a setting.

On the platelet or head 3 and on the underlying part 10 of the support of FIGS. 1 and 2 has to be fixed or mounted, in a removable manner, a female coupling element 15 which is entirely located within a setting or mount which is namely represented in FIGS. 3, 5 and 6.

The setting designated generally by reference 12 comprises, for example, a basket or bezel 13 (see namely FIGS. 3 and 5, 19 to 23) provided with claws, between which are crimped or set one or more precious stones 14, such as brilliants (see FIGS. 5 and 19 to 23).

In the setting 12 is embedded and permanently fixed a female coupling element generally designated by reference 15. The back face 16 of this female coupling element 15 is co-planar with the back face 17 of the basket 13 forming the setting 12, so that the female coupling element 15 is entirely located inside the setting 12.

The female coupling element 15 is provided with a slide 18 having an opening 19 toward the back face 16 of the female element 15, the opening 19 running also in two opposite side faces 20 and 21 of the element 15. In the embodiment shown in FIGS. 3 and 5, the cross-section of the slide 18 has at least one part 22 which is broader than the opening 19, so that when the male coupling element (part 10 and platelet 3) is inserted into the slide 18 of the female coupling element 10, 3 15, it is impossible to remove the male element from the female element 15 through the opening 19 of the latter, which opens in the back face 16, in the direction of arrows X.

In the embodiment shown in FIG. 5, the male coupling element (part 10 and platelet 3) integral with the support 2 and the slide 18 of the female coupling element 15 have substantially a T-shaped section. The platelet 3 may possibly be provided with means such as side grooves provided in the side faces 23, 24 of the platelet, so as to permit an adjustment of the friction between said platelet 3 and the slide 18 by relative deformation of the side faces.

As shown particularly in FIGS. 3 and 5, the female coupling element or receptacle 15 has the general shape of a rectangular parallelepiped, but it can have any other suitable shape allowing it to be positioned permanently inside a setting, such as a basket carrying precious or non precious stones.

When the female coupling element 15 is placed upon the male coupling element 10, 3, the latter is inserted into the slide 18 of the female coupling element with some friction. Thus, the upper face 4, the side faces 23, 24 and part of the lower face 11 of the platelet 3 are in contact with the inner wall 25 of the broad part 22 of the slide with some friction allowing the female coupling element 15 to slide onto the platelet 3 and part 10 of the male coupling element, either for positioning the latter on the male coupling element as indicated by arrow Y, or for removing it in the opposite direction of said arrow Y (FIG. 6).

Along a lower edge of the female coupling element or receptacle 15, there are two ears 26 which are each provided with a horizontal hole 27 of circular section, said ears 26 being separated from each other by a groove 28. A rod 29 extends in the horizontal hole 27 of the ears 26, the rod 29 being the pivot of a blocking lever designated generally by reference number 30. The pivot 29 may be non rotating or may rotate in the holes 27. In its use position, the lever 30 extends in the groove 28 provided between the ears 26, the lever 30 being capable of pivoting in the direction of arrows Z (see FIG. 5) aroung the pivot 29. At its end 34 opposed to its end 32, the lever 30 has an upwardly directed flange 35. When the lever 30 is pivoted counter-clockwise, the flange 35 overlaps, for example with a snapping action, a shoulder or boss 36 of the female coupling element 15, so that the lever 30, part 31 of which passes through the notch 9 of part 10 of the support 2, is maintained in the closed position by the shoulder 36 and forms thereby a clamping means inhibiting any accidental removal of the setting 12 from the support 2.

FIG. 5 shows that the lever 30 carries, in the vicinity of its end 32, on its upper face 38, a boss 39 having such a shape that the setting 12 cannot be removed or separated from the support 2 unless the pivot 30 has pivoted on more than 90° (as shown by dotted lines) from its blocking or closed position to its opening position. FIG. 5 shows also a gripping tab 37 provided at the face end 34 of the lever 30.

As shown in FIG. 5, when the lever 30 is in its blocking position, the lever 30 is embedded in the female coupling element 15, the latter being itself located inside the setting 12. In the position of the lever 30, the latter extends in the notch 9 of the part 10 of the support 2 underlying the platelet 3 and is practically flush with the back face 16 of the female coupling element 15, the back face 16 being co-planar with the back face 17 of the basket 13 forming the setting 12.

FIGS. 7 to 13 show schematically, as illustrative and non limitative examples, various shapes of the male coupling elements 3, 10 and of the corresponding female coupling elements 15 of the settings 12.

In FIG. 7, the platelet 3, as well as the corresponding part of the slide 18 of the female coupling element 15 flare out upwardly, so that they have a trapezoidal section, whereas in FIGS. 3 and 5, these elements have a T-shaped cross-section.

FIG. 8 shows a platelet 3 and a corresponding part of the slide 18 having a cylindrical shape with a diameter which is larger than the width of the opening 19 of said slide 18.

In FIG. 9, the platelet 3 consists merely of an horizontal piece rigidly connected at one end with part 10 of the support 2, whereas the slide 18 of the female coupling element 15 which is fixed into the setting 12 has the shape of an inverted L.

FIG. 10 shows a platelet 3 comprising two inclined parts integral with part 10 of the support 2, the slide 18 of the female coupling element 15 having a complementary Y-shape.

FIG. 11 shows a male coupling element 3 having an inclined wing integral with part 10 of the support 2 and a horizontal wing rigidly connected to said inclined wing. The slide 18 of the female coupling element 15 has a corresponding shape.

FIG. 12 shows an arrangement in which the slide 18 of the female coupling element 15 has the shape of an arrow having an upper surface 40 formed by two inclined faces. The male coupling element (platelet 3 and part 10) of the support 2 has also an arrow-shaped cross-section.

In FIG. 13, the upper part of the slide 18 of the female coupling element 15, as well as the platelet 3 have a cross-section corresponding to two trapezoids connected to each other at their smaller bases.

In FIGS. 7 to 13, the projection or platelet 3 of the support 2 (ring) has a width which is larger than that of its bases or lower part 10 of the support 2, whereas the slide 18 of the female coupling element 15 has a corresponding width which is larger in the vicinity of the bottom of said slide than at its opening 19.

The various shapes of the male coupling elements 3, 10 and of the slides 18 of the female coupling elements as shown in the drawings inhibit a separation of the setting 12 from the support 2, when the setting 12 is mounted on the support 2, in a vertical direction (when considering the drawings), i.e. in the direction of arrows X. In some of these embodiments, the female coupling element 15 has a cross-section with at least a part thereof making an angle of less than 180° with their remaining part (see FIGS. 7, 9, 10, 11 and 12). Therefore, when a pull is exerted on a setting 12 in the direction of arrows X, it is absolutely impossible to remove said setting from the support 2.

In the above-described embodiments, the projection or platelet 3 rigidly connected to part 10 of the support has such a shape that when it is inserted in the correspondingly-shaped slide 18 of the female coupling element 15 positioned inside the setting 12, the latter can only be separated from the platelet 3 in one direction, i.e. the direction opposed to the direction of arrow Y in FIG. 6. This latter direction corresponds to a longitudinal axis of the platelet 3 and of the broadened part of the slide 18, this axis being shown by the dotted and dashed lines P-P in FIG. 1.

FIG. 14 is a perspective view of a female coupling element 15 provided with an arrow-shaped slide 18, which can be positioned on a platelet 3 similar to that illustrated in FIG. 12.

Figure 15:
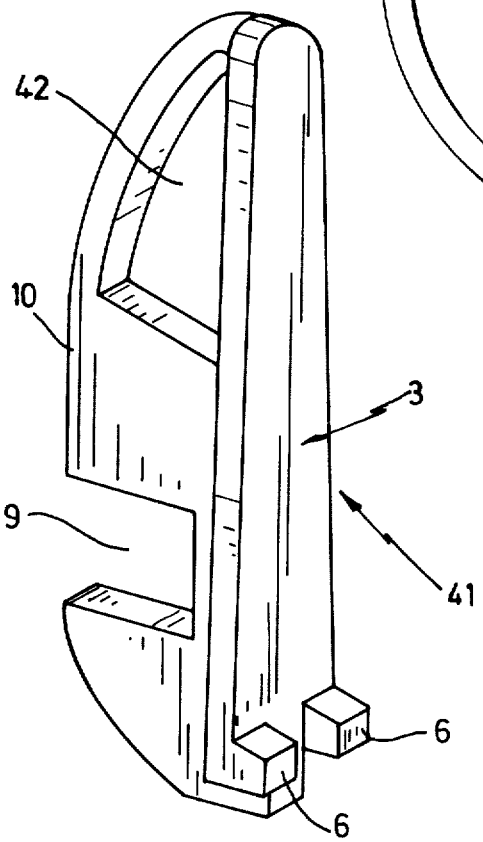
FIG. 15 is a perspective view of a sling of a pendant provided with a male coupling element.

FIG. 15 is a perspective view of a sling of a pendant which may be attached to a small chain or to a necklace (not shown). The sling generally designated by reference number 41 has a part 10, in which there is a eyelet 42 for a small chain or a necklace and a part 3 which is integral with part 10, two stops 6 being provided at the end of part 3. Parts 10 and 3 have a T-shaped cross-section and constitute a male coupling element. A notch 9 is provided in part 10 of the sling. As indicated in the various above-described embodiments, the female coupling element 15 located inside a setting 12 can be inserted and blocked into the female coupling element 15 of said sling 41. As in the embodiment illustrated in FIG. 5, a setting 12 in which a female coupling receptacle 15 provided with a slide 18 and with a blocking lever 30 of the type shown in FIG. 4 or in FIG. 5 is permanently fixed, allows a stiff positioning of said setting 12 on the sling 41.

Figure 16:
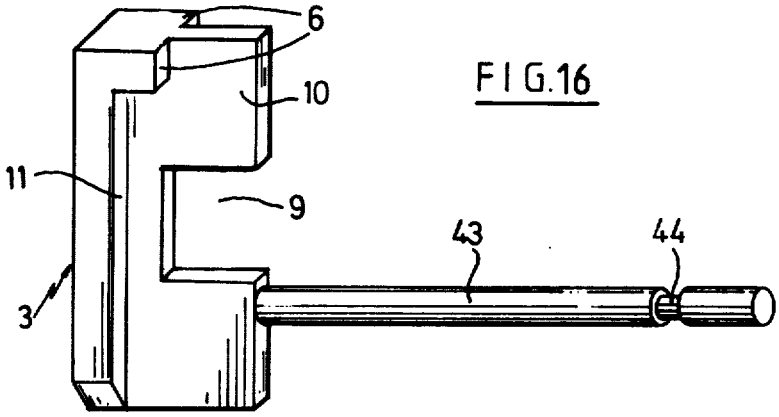
FIG. 16 is a perspective view of an earring provided with a male coupling element cooperating with the female coupling element located in a setting (not represented) such as the setting shown in FIG. 3.

FIG. 16 shows an ear-ring comprising a rod 43, one end of which is provided with a notch 44 for receiving a stop element (not shown). To the other end of the rod 43 is fixed the male coupling element comprising a piece 10 supporting a platelet 3, for example of the type illustrated in FIG. 1, the platelet carrying stops 6 on its lower face 11 adjacent to piece 10.

Figure 4:
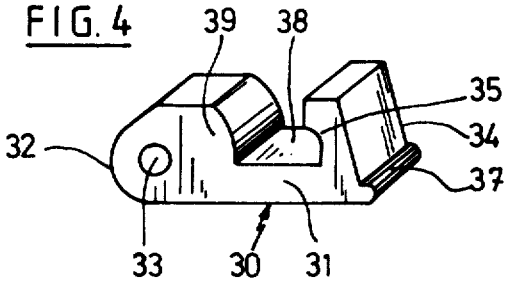
FIG. 4 is a perspective view of a locking means comprising of a lever carried by the female element mounted inside the setting represented in FIG. 3.

A female coupling element 15, for example of the type shown in FIG. 3, positioned within a setting 12, may be slipped and blocked on the platelet 3 and on the piece 10, blocking means, such as a lever of the type shown in FIG. 4 or FIG. 5, being used for avoiding any accidental separation between the setting 12 and the piece 10 and the platelet 3.

Figure 17:
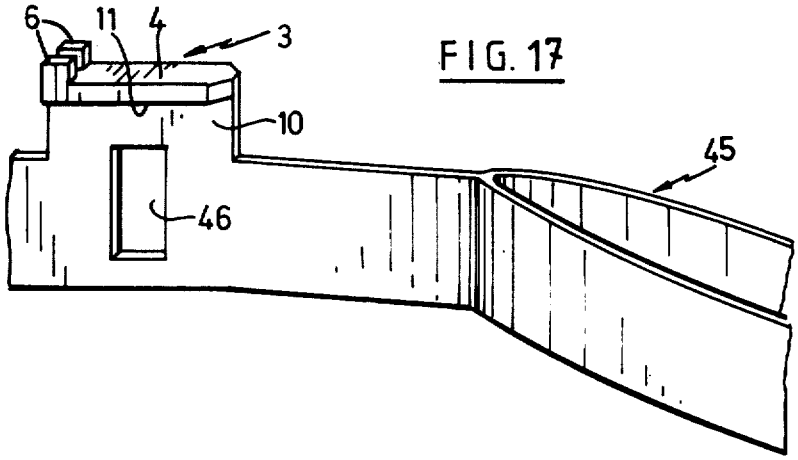
FIG. 17 is a perspective view showing partially an earring or necklace provided with a male coupling element and adapted for receiving a female coupling element located in a setting (not represented)

FIG. 17 shows a bracelet 45 (partially shown) carrying a piece 10 integral with a platelet 3 which may be of the type illustrated in FIG. 1. The platelet 3 and the piece 10 can be inserted into the slide 18 of a female coupling receptacle 15 mounted inside a setting which may, for example, be similar to that designated by reference number 12 in FIGS. 3, 5 and 6. The setting 12 carries a blocking element such as a lever extending through an opening 46 provided in piece 10.

Figure 18:
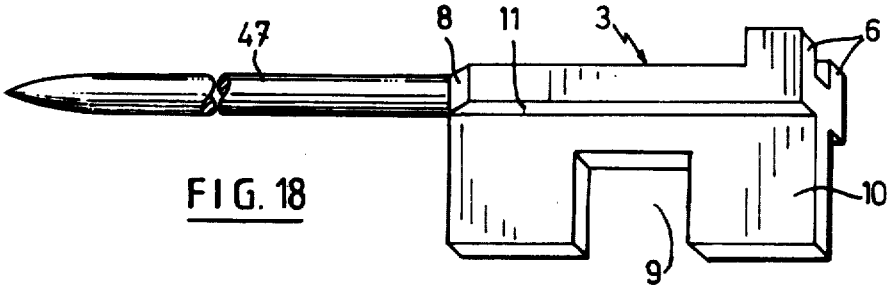
FIG. 18 is a perspective view of a tie-pin or brooch provided with a projecting part on which a female coupling element located in a setting (not represented) may be clamped.

FIG. 18 represents a brooch or tie-pin on which can be mounted a setting through a female coupling element 15 provided with a slide 18, the female coupling element 15 being permanently fixed within the setting. The brooch or tie-pin comprises a pointed rod 47, one end of which carries a piece 10 and a platelet 3 similar to those designated by the same reference numbers namely in FIG. 1. On a platelet 3 integral with piece 10 may be slipped a setting 12, for example of the type illustrated in FIGS. 3, 5 and 6, a clamping lever 30 being provided for maintaining the setting 12 integrally connected to the platelet 3, the lever passing through the notch 9. When the lever 30 is brought into its open position the setting 12 can be removed from the platelet 3 and the piece 10.

FIGS. 19 to 23 show that it is possible to use the same setting 12 comprising a basket 13 in which precious stones 14 are gripped on a support consisting of a ring 2 (FIG. 19), a sling 41 of a pendant provided with a chain 48 (FIGS. 20 and 21), a brooch or a bar 49 provided with a pin (FIG. 22) or a bracelet 50 (FIG. 23).

It is pointed out that FIGS. 1 to 23 show various embodiments of the invention represented in a large scale for the clarity of the illustration; the components of the embodiments can be combined or associated in different ways.

The above description shows that the system according to the invention allows the connection, in a removable and interchangeable manner, of a single setting in which is located a female receptacle to various supports of different sizes and/or natures. This connection can be realized in a reliable manner, without affecting detrimentally the aesthetic aspect of the jewels. The fixing and blocking systems according to this invention are indeed very reliable and can be easily and quickly handled. Moreover, the strength and the aesthetic character of the jewelry articles according to this invention are comparable to those of jewelry articles manufactured by the usual techniques.

Thus, as shown by the above description, the jewelry article sets according to this invention have the following outstanding advantages:

(1) the sets are particularly simple, in so far as a single type of receptacle 15 can be used as a female coupling element which may be mounted within settings of a plurality of different types;

(2) in respect of the aesthetic character, the jewel (ring, pendant sling, ear-ring and the like), is identical to a single piece jewel manufactured by the usual techniques, since the coupling system is invisible when the jewel is worn by a person;

(3) finally, in connection with security and reliability, the lever for clamping together the assembled male and female coupling elements is inaccessible when the set of pieces according to the invention, in the form of a ring or of an ear-ring, is worn by a person. When the jewel comprises a pendant sling, for example of the type shown in FIG. 15, the small chain 48 (FIG. 21) to which said sling is attached inhibits the separation of the setting therefrom, even if the lever 30 would accidently become opened. Finally, when the jewel is a tie-pin or a brooch, as shown in FIG. 18, a separation between the setting and the support is impossible, even when the blocking lever is accidentally opened, since a longitudinal displacement of the setting 12 with respect to the support 3, 10 is inhibited by the garment on which the pin or brooch is placed, whereas a separation between the setting 12 and the support 3, 10 in the direction of the arrows X is also impossible, due to the fact that the diameter of the pin 47 (FIG. 18) of the tie-pin or of the brooch is larger than the width of the opening 19 of the slide 18.

Due to this invention, it is possible to place in a single jewel-case, at least one setting and a plurality of supports, for the presentation and tidying of these various elements.

What we claim is:

1. A jewelry article set comprising:

a support;

a setting having an ornamental element on a front face thereof and a backface;

male and female elements for coupling said backface of said setting to said support;

said female element being located and permanently fixed inside said setting and having a first groove which is open towards said backface of said setting and toward two opposite faces of said female element, said first groove having first and second parts, said first part of said first groove being broader than said second part, said second part of said first groove opening towards said backface of said setting and having an end which is substantially co-planar with said backface of said setting;

said male element having a shape complementary to that of said first groove so that when said male element is inserted into said first groove of said female element through one of said two opposite faces of said female element, both said male and female elements are hidden from view and it is impossible to disengage said male element from said female element through said second part of said first groove;

a blocking lever for fastening said male and female elements together, said blocking lever having one end connected to a pivot connected to said female element and having means on its other end for gripping said lever to a boss of said female element located inside said setting to fasten said blocking lever other end to said boss, when fastened said blocking lever extending within said setting and preventing a sliding movement between said male and female elements;

said male element being a part of said support; and a notch provided in said support through which said blocking lever extends when it is fastened.

2. The jewelry article set according to claim 1, wherein said female element has a second groove substantially co-planar with said backface of said setting, said blocking lever being embedded in said second groove when fastened and said second groove being substantially perpendicular to said second part of said first groove of said female element.

3. The jewelry article set according to claim 1, wherein said male element has a first part having a shape which corresponds to that of said first part of said first groove which is broader than said second part of said first groove, said male element having a second part having a smaller width than said first part of said male element and which has a shape corresponding to that of said second part of said first groove, said notch of said male element being opposed to said first part of said male element.

4. The jewelry article set according to claim 3, wherein said first part of said male element is a projection of said support.

5. The jewelry article set according to claim 1, wherein said blocking lever has a boss on a face directed towards said first and second parts of said first groove when the blocking lever is fastened, said blocking lever boss having a shape such that said setting can only be separated from said support by a relative sliding of the setting with respect to the support in the direction of one of said two opposite faces of said groove when said lever has pivoted more than 90° from its fastening position.

6. The jewelry article set according to claim 1, further comprising at least one additional support, said additional support having a size different than said first support.

7. The jewelry article set according to claim 1, wherein said male and female elements have a substantially T-shaped cross-section.

8. The jewelry article set according to claim 1, wherein said male element has at least one stop limiting a distance said male element can be inserted into said female element.

9. The jewelry article set according to claim 1, wherein said support comprises at least one element selected from the group consisting of finger rings, slings, earrings, brooches, tie-pins, cuff-links, necklaces and bracelets.

10. The jewelry aticle set according to claim 1, wherein said female element has at least one stop limiting a distance said male element can be inserted into said female element.

* * * * *